US010131510B2

(12) United States Patent
Nützel

(10) Patent No.: US 10,131,510 B2
(45) Date of Patent: Nov. 20, 2018

(54) DRAW-IN DEVICE FOR SHEET-TYPE ARTICLES

(71) Applicant: CI Tech Components AG, Burgdorf (CH)

(72) Inventor: Dominik Nützel, Neuried (DE)

(73) Assignee: CI Tech Components AG, Burgdorf (CH)

( * ) Notice: Subject to any disclaimer, the term of this patent is extended or adjusted under 35 U.S.C. 154(b) by 8 days.

(21) Appl. No.: 15/029,113

(22) PCT Filed: Oct. 15, 2014

(86) PCT No.: PCT/EP2014/072127
§ 371 (c)(1),
(2) Date: Apr. 13, 2016

(87) PCT Pub. No.: WO2015/055721
PCT Pub. Date: Apr. 23, 2015

(65) Prior Publication Data

US 2016/0251177 A1 Sep. 1, 2016

(30) Foreign Application Priority Data

Oct. 18, 2013 (DE) ..... 10 2013 221 236

(51) Int. Cl.
*B65H 29/70* (2006.01)
*B65H 5/06* (2006.01)
*B65H 29/12* (2006.01)

(52) U.S. Cl.
CPC ..... *B65H 5/062* (2013.01); *B65H 29/125* (2013.01); *B65H 29/70* (2013.01);
(Continued)

(58) Field of Classification Search
CPC .... B65H 2404/1416; B65H 2404/1415; B65H 2404/1321; B65H 2404/13161;
(Continued)

(56) References Cited

U.S. PATENT DOCUMENTS 5,078,384 A 1/1992 Moore
6,321,902 B1 11/2001 Stäb
(Continued)

FOREIGN PATENT DOCUMENTS

DE 691 10 005 1/1996
DE 197 35 051 2/1999
(Continued)

OTHER PUBLICATIONS

Machine translation of JP2010-195572.*
(Continued)

*Primary Examiner* — Thomas A Morrison
(74) *Attorney, Agent, or Firm* — Jenkins, Wilson, Taylor & Hunt, P.A.

(57) ABSTRACT

A draw-in apparatus having at least two rotatable draw-in rollers for drawing in sheet goods, in particular bank notes, wherein the draw-in rollers are arranged relative to each other with meshing roller profiles respectively extending transversely to the draw-in direction so as to define a draw-in gap for the sheet goods, and wherein the draw-in rollers have axial cross-sectional profiles mutually matched such that a clearance between the draw-in rollers changes periodically upon a rotation of the draw-in rollers.

20 Claims, 7 Drawing Sheets

(52) U.S. Cl.
CPC ..... *B65H 2301/5122* (2013.01); *B65H 2404/1311* (2013.01); *B65H 2404/141* (2013.01); *B65H 2701/1912* (2013.01)

(58) Field of Classification Search
CPC .... B65H 2404/1316; B65H 2404/1311; B65H 2404/121; B65H 2404/1119; B65H 2404/1118; B65H 2404/1116; B65H 2404/111; B65H 2404/11; B65H 2404/141; B65H 2301/5122; B65H 29/70; B65H 29/125
See application file for complete search history.

(56) References Cited

U.S. PATENT DOCUMENTS 8,496,249 B2 * 7/2013 Dowling ..... B65H 29/58 271/225
2009/0212495 A1 8/2009 Okuno
2010/0221052 A1 9/2010 Kyoichi et al.
2010/0278576 A1 * 11/2010 Suzuki ..... B65H 29/22 399/405
2012/0211936 A1 * 8/2012 Whitten ..... B65H 29/12 271/109

FOREIGN PATENT DOCUMENTS

EP 1 578 682 A2 9/2005
JP 2010-195572 * 9/2010

OTHER PUBLICATIONS

International Search Report with Written Opinion for Application No. PCT/EP2014/072127 dated Jan. 27, 2015.
English Translation of the International Search Report with Written Opinion for Application No. PCT/EP2014/072127 dated May 15, 2015.
German Office Action for Application No. 102013221236 dated Jul. 21, 2014.

* cited by examiner

DRAW-IN DEVICE FOR SHEET-TYPE ARTICLES

BACKGROUND

The present invention concerns a draw-in apparatus for sheet goods, in particular for value documents, such as bank notes. The draw-in apparatus can be located in particular as an input interface for sheet goods in the form of bank notes on a bank-note machine, automatic teller machine, ticketing machine, vending machine, or the like. The invention concerns in particular a draw-in apparatus that can reliably prevent disturbances through attempts to input objects other than sheet goods, and the penetration of foreign bodies such as dust.

From EP 1 578 682 B1 a conveyor is known for bank notes, wherein a bank note is gripped by means of surfaces of two rotationally symmetric draw-in rollers which respectively have a wave-shaped longitudinal sectional profile transverse to the draw-in direction, and which intermesh. The surfaces are at a firmly adjusted predetermined distance apart in every rotational position upon the drawing in of a bank note, and thus define a draw-in gap extending non-linearly transversely to the draw-in direction and having a gap dimension that is greater than the thickness of a bank note. The intermeshing draw-in rollers cause the bank note to bow transversely to the draw-in direction, regarded in the transport direction, such that the force by which the bank note is gripped depends on the rigidity of the bank note. EP 1 578 682 B1 further mentions that the distance between the draw-in roller surfaces can be reduced to zero, for example when the device is to be cleaned with a high-pressure water jet.

At input interfaces for bank notes on machines, such as bank machines, ticketing machines, vending machines, or the like, there is frequently the problem that users or customers mistakenly attempt to feed a credit card or the like to the machine instead of a bank note. This can lead to disturbances in the machine or to damage of the card. EP 1 578 682 B1 thus proposes measuring the force acting on the draw-in rollers and stopping or reversing the rotation direction when a pre-specified force is exceeded.

SUMMARY

It is an object of the present invention to configure a draw-in apparatus for sheet goods with simple constructional means so as to prevent a feed of objects other than the intended sheet goods by users, and the penetration of foreign bodies and soiling through the draw-in gap in phases when no sheet goods are drawn in.

This object is achieved by a draw-in apparatus for sheet goods having the features of independent claim 1. Developments and advantageous embodiments are stated in the respective dependent claims.

The core of the invention is that at least two rotatable draw-in rollers having cross-sectional profiles, for drawing in sheet goods, which respectively extend transversely to the draw-in direction and mesh, being arranged relative to each other in a draw-in apparatus so as to define a draw-in gap for the sheet goods, are configured such that the gap dimension of the draw-in gap is changed synchronously with the rotation. Preferably, the gap dimension changes periodically between a maximum draw-in gap height and a minimum draw-in gap height synchronously with the rotation as the modulation stroke upon rotation of the draw-in rollers.

The gap dimension or the height of the draw-in gap is understood here to be the clearance between the draw-in rollers, i.e., the distance between the surfaces, opposing each other at the draw-in gap, of the draw-in rollers which define the draw-in gap.

A draw-in apparatus according to the invention thus has at least two rotatable draw-in rollers having meshing longitudinal sectional profiles respectively extending transversely to the draw-in direction for drawing in sheet goods, in particular bank notes, wherein the draw-in rollers are arranged relative to each other so as to define a draw-in gap for the sheet goods, and wherein the draw-in rollers, preferably at every place of the draw-in gap, respectively have an axial cross-sectional profile mutually matched such that a gap dimension of the draw-in gap changes periodically upon a rotation of the draw-in rollers, preferably with a predetermined stroke.

The modulation of the gap dimension effected periodically due to the rotation of the draw-in rollers causes a special effect in the draw-in apparatus according to the invention: upon an attempt to feed to the draw-in means an object thicker than sheet goods of intended dimensions, such as an EC card or credit card, there is produced a jerking on the card that is perceptible to a user. For example, a credit card is pushed a few millimeters in the direction of the user out of the draw-in gap or an acceptance slot arranged on a corresponding machine. This especially advantageously gives rise to a haptically perceptible feeling of the rejection. Therefore, the draw-in of rigid foreign bodies, such as coins or EC cards, check cards, credit cards, or the like, is prevented by the haptic perception drawing the user's attention to the situation as feedback.

According to one development, the draw-in rollers can be so configured that in at least one defined rotational position a smallest gap dimension is approximately zero, preferably minimal according to the thickness of the sheet goods, so that the draw-in gap is closed in the rotational position (e.g., a closed rotational position). This avoids the sheet goods being crushed when being drawn in, and the pivot bearings of the draw-in rollers are subjected to less load. This is advantageous in particular when the surfaces of the draw-in rollers are formed of an inelastic material. Preferred values for the variable gap dimension are from approximately the thickness of the sheet goods, preferably 0.2 mm (>0 mm) as the smallest gap dimension for the closed rotational position, up to 1.0 mm as the greatest gap dimension.

It is in principle also possible, in particular when at least the surface of one of the draw-in rollers is formed of an elastic material, to configure the draw-in rollers such that a contact line, which is preferably uninterrupted, is formed between the circumferences of the at least two draw-in rollers in a closed rotational position.

Thus, a closure for the draw-in gap can be provided without additional effort in the draw-in apparatus according to the invention. No separate closure or closure device is then required.

The thus realized closure device can for example prevent a customer from feeding a bank note to a vending machine when the machine has no more change available. Further, when a machine has, for example, gone out of operation due to a disturbance, its draw-in gap can be especially simply adjusted to a minimal gap dimension and therefore closed by means of the draw-in rollers. Quite generally, the draw-in rollers can therefore be moved into the closed rotational position especially simply in a machine, for example, whenever no sheet goods are being drawn in, so that the interior of the machine is protected from attempts at tampering from outside or, more broadly, from the penetration of foreign bodies and soiling.

Preferably, the meshing of the draw-in rollers, viewed in the draw-in direction, is attained by means of the accordingly designed longitudinal sectional profiles of the draw-in rollers (roller profiles). For this purpose, the roller profiles can have respectively alternating first and second roller portions. Therefore, the draw-in gap for the sheet goods extends non-linearly. Particularly and preferably, the first and second roller portions are of a wave-shaped configuration. The respectively periodically alternating first and second roller portions can be configured as convex and concave roller portions alternating in the longitudinal direction on the respective draw-in roller.

Preferably, the axial cross-sectional profile of at least one of the draw-in rollers has, at least in one roller portion, a circumferential line course for modulating the gap dimension according to the invention. The modulating circumferential line course is characterized in that the radius of points on the circumferential line changes in the circumferential direction, preferably continuously, between at least one minimum value and at least one maximum value over the total circumference.

For example, the modulating circumferential line course of the axial cross-sectional profile can be cam-shaped, i.e., extend according to a cam disk with a maximum value for the radius at the location of the cam and with a minimum value of the radius in a circular circumferential portion opposing the cam.

A modulating circumferential line course of the axial cross-sectional profile can also be attained with a circular axial cross-sectional profile which is arranged eccentrically relative to the rotation axis of the draw-in roller. Although all points of the circumferential line then lie on a circular line, the radius responsible for the modulating circumferential line course is determined relative to the rotation axis of the draw-in roller. The point of the eccentric circular circumferential line with the greatest radius, measured from the rotation axis of the draw-in roller, is then the point of the modulating circumferential line course with the greatest radius and is opposite the point of the modulating circumferential line course with the smallest radius.

A further example of a modulating circumferential line course according to the invention is an elliptical axial cross-sectional profile. At locations of the circumference that are intersected by the greatest principal axis of the ellipse, the circumferential line course respectively has a greatest radius. At locations of the circumference that are intersected by the smallest principal axis of the ellipse, the circumferential line course then respectively possesses a smallest radius. When the minimum value of the gap dimension is adjusted for realizing a closed rotational position, then the draw-in apparatus therefore possesses exactly two closed rotational positions which are mutually offset in the circumferential direction by 180° due to the mirror symmetry of the elliptical axial cross-sectional profile.

It will be appreciated that the hereinabove explained principle of the invention can also be implemented using a multiplicity of other axial cross-sectional profiles for the draw-in rollers, such as a polygonal course of the circumferential lines of the draw-in rollers, or the like. For attaining an integrated way of closing the draw-in gap it suffices to ensure only in a single closed position that the gap dimension of the draw-in gap is sufficiently minimal, in particular closed.

It suffices that the axial cross-sectional profile of the draw-in rollers respectively has only one axial cross-sectional profile with a circular circumferential line course in those roller portions opposing a roller portion of the other draw-in roller with a modulating circumferential line course. That is to say, the gap dimension of the draw-in gap is then modulated in the respective roller portion only by one of the two draw-in rollers.

In principle, one draw-in roller or both draw-in rollers can have a modulating circumferential line course in all roller portions.

It is possible to provide the modulating circumferential line course in all roller portions on only one of the draw-in rollers and the circular circumferential line course in all roller portions on the other one of the draw-in rollers. That is to say, in this embodiment only one of the draw-in rollers possesses cross-sectional profiles with a modulating circumferential line course, but then preferably over the total length of the draw-in gap, whereas the other one of the draw-in rollers has cross-sectional profiles with a circular circumferential line course over the total length of the draw-in gap. In this case, only the modulating draw-in roller needs to be controlled when the rotating draw-in rollers are for example to be so stopped, that the gap dimension of the draw-in gap is for example to be minimal.

In a preferred embodiment, each of the draw-in rollers respectively has the modulating circumferential line course in the convex roller portions and the circular circumferential line course in the concave roller portions, or vice versa. In this manner, the two draw-in rollers can be configured identically to each other. In the installation position the draw-in rollers are then accordingly arranged mutually offset by the length of a roller portion and in an intermeshing manner.

By rotation of the draw-in rollers configured according to one of the hereinabove explained variants, the gap dimension of the draw-in gap can be modulated by the draw-in rollers' cross-sectional profiles respectively opposing each other in the draw-in gap. This modulation, effected periodically due to the rotational motion of the draw-in rollers, produces the above-mentioned jerking effect in the draw-in apparatus according to the invention, which can be felt haptically on the card upon an attempt to feed thick objects, such as EC cards or credit cards, to the draw-in means.

In principle, the roller body forming the surfaces of the draw-in rollers can consist of a malleable material or be coated therewith if an especially good seal is desired, e.g., against liquids in the at least one closed rotational position, or to ensure additional frictional forces between the draw-in rollers and sheet goods to be drawn in.

In a particularly preferred development, the draw-in rollers are preferably made of an inelastic material, for example metal or a rigid plastic. This can prevent attempts at tampering from outside when the draw-in rollers are in the closed rotational position better than, for example, with draw-in rollers that are coated with a rubber layer having high elasticity or that consist of a material with high elasticity. An elastic material can be more easily pushed away or urged to the side upon an attempt at tampering. Preferably, the draw-in rollers consist of a material with low elasticity, for example, of—in particular fiber-reinforced—polyaniide 6 GF 25. However, they can equally well consist of non-fiber-reinforced plastics such as POM (polyoxymethylene) or PC/ABS (polycarbonate/acrylonitrile butadiene styrene).

Through the intermeshing radial roller profiles, the draw-in gap extends non-linearly transversely to the draw-in direction such that the intended sheet goods are bowed between the draw-in rollers and a draw-in force exerted by the draw-in rollers on the sheet goods, by which force the sheet goods are gripped and drawn in, depends on the rigidity of the sheet goods. Objects having a higher rigidity cannot adapt to the above-described geometry and hence are not drawn in. On such objects the rotational motion of the draw-in rollers with the periodic modulation produces the above-described jerking effect.

Preferably, the at least two draw-in rollers are arranged rotatably around respective rotation axes which are at a fixed distance apart. Particularly preferably, the rotation axes extend parallel to each other and are arranged transversely to the draw-in direction.

The at least two draw-in rollers can be force-coupled rotationally at least at one end, in particular by means of meshing gears. This ensures that the draw-in rollers always rotate in mutual synchronism. Furthermore, only one of the draw-in rollers thus needs to be driven for rotation of both draw-in rollers.

For detecting at least one defined rotational position, which is preferably the closed rotational position, one of the draw-in rollers can be coupled to a corresponding closed rotational position detecting device. The device for detecting the at least one closed rotational position can have at least one marking means firmly coupled to one of the draw-in rollers, and a sensor, in particular a light sensor, magnetic sensor or capacitive sensor, for sensing the position or a property of the at least one marking means.

The marking means can be, for example, at least one index hole in an indexing plate coupled to the at least one draw-in roller. The device for detecting the at least one closed rotational position can then be a light-barrier sensor arranged so as to cooperate operatively with the indexing plate.

The marking means can likewise be a diametrically magnetized magnet which is fastened non-rotatably to the at least one draw-in roller. The device for detecting the at least one closed rotational position can then be formed by at least one magnetic sensor, in particular at least one Hall sensor.

The device for detecting the at least one closed rotational position can also be realized by a 360° absolute angle sensor which is coupled to at least one of the draw-in rollers. It is then possible to immediately output, without referencing, an absolute value which unambiguously identifies the current rotational position of the draw-in roller.

The draw-in apparatus can further have an, in particular exclusive, draw-in roller drive coupled to the draw-in rollers, and a control device operatively connected to the draw-in roller drive. The control device is preferably connected to the device for detecting the at least one closed rotational position as a defined rotational position and is configured to control the draw-in roller drive for closing the draw-in gap such that the draw-in rollers are located in the defined closed rotational position at the moment of stopping of their rotational motion.

The draw-in apparatus according to the invention is particularly suited for sheet goods, particularly for value documents such as bank notes, on bank-note machines, automatic teller machines, ticketing machines, vending machines, or the like. The draw-in apparatus according to the invention is of course also suitable for sheet goods for other fields of application in which sheet-like objects are to be drawn in at an input interface.

Further advantages, features and details of the invention will result from the following description, in which embodiment examples of the invention will be described in detail with reference to the drawings. The features mentioned in the claims and in the description may be essential to the invention individually per se or in arbitrary combination. Likewise, the hereinabove mentioned features and those specified hereinbelow may be employed each per se or in groups in arbitrary combinations. Functionally similar or identical members or components are furnished in part with the same reference signs. The terms "left", "right", "above" and "below" employed in the description of the embodiment examples relate to the drawings as oriented with the figure designation or reference signs in the normally legible way. The shown and described embodiments are not to be understood as exhaustive, but have an exemplary character for explaining the invention. The detailed description is for the skilled person's information, so that known circuits, structures, and methods are not shown or explained in detail in the description so as not to impede the understanding of the present description.

DETAILED DESCRIPTION

Figure 1:
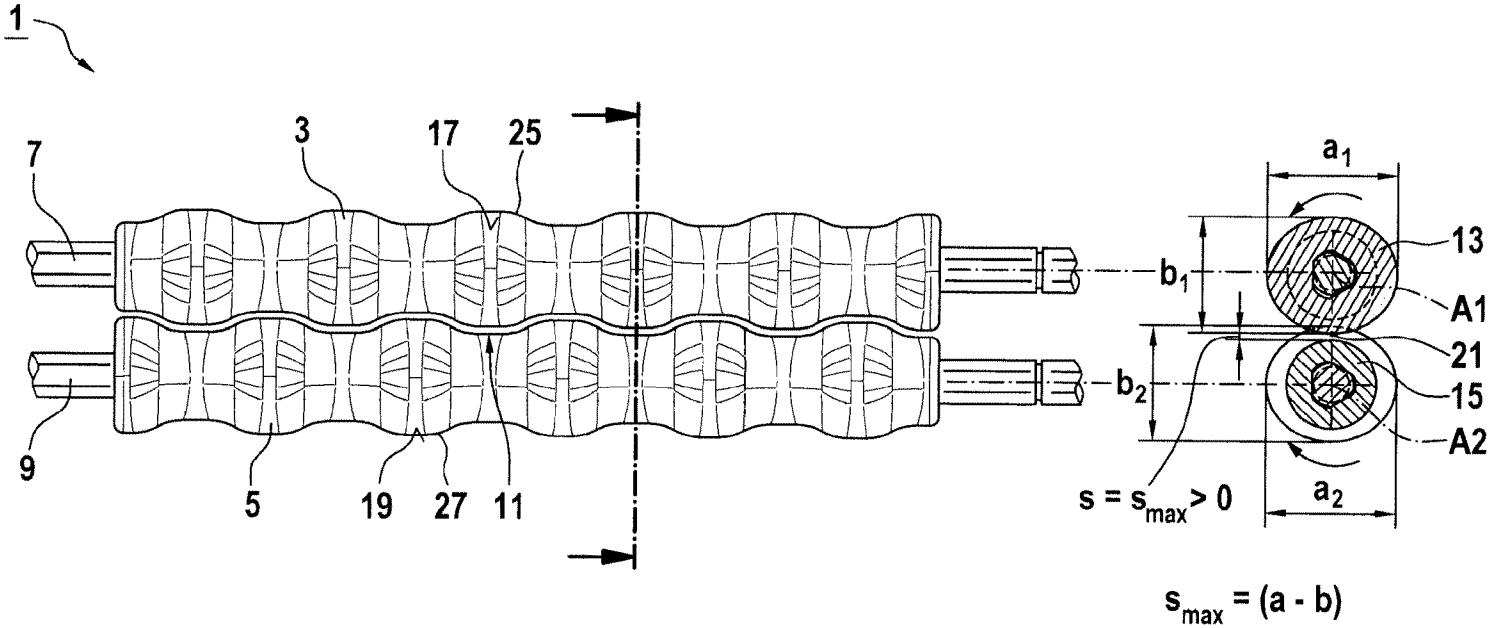
FIG. 1: A schematic view of a draw-in apparatus according to an embodiment example looking at the draw-in rollers in the draw-in direction, and on the right an axial sectional view along the specified sectional line.
Figure 2:
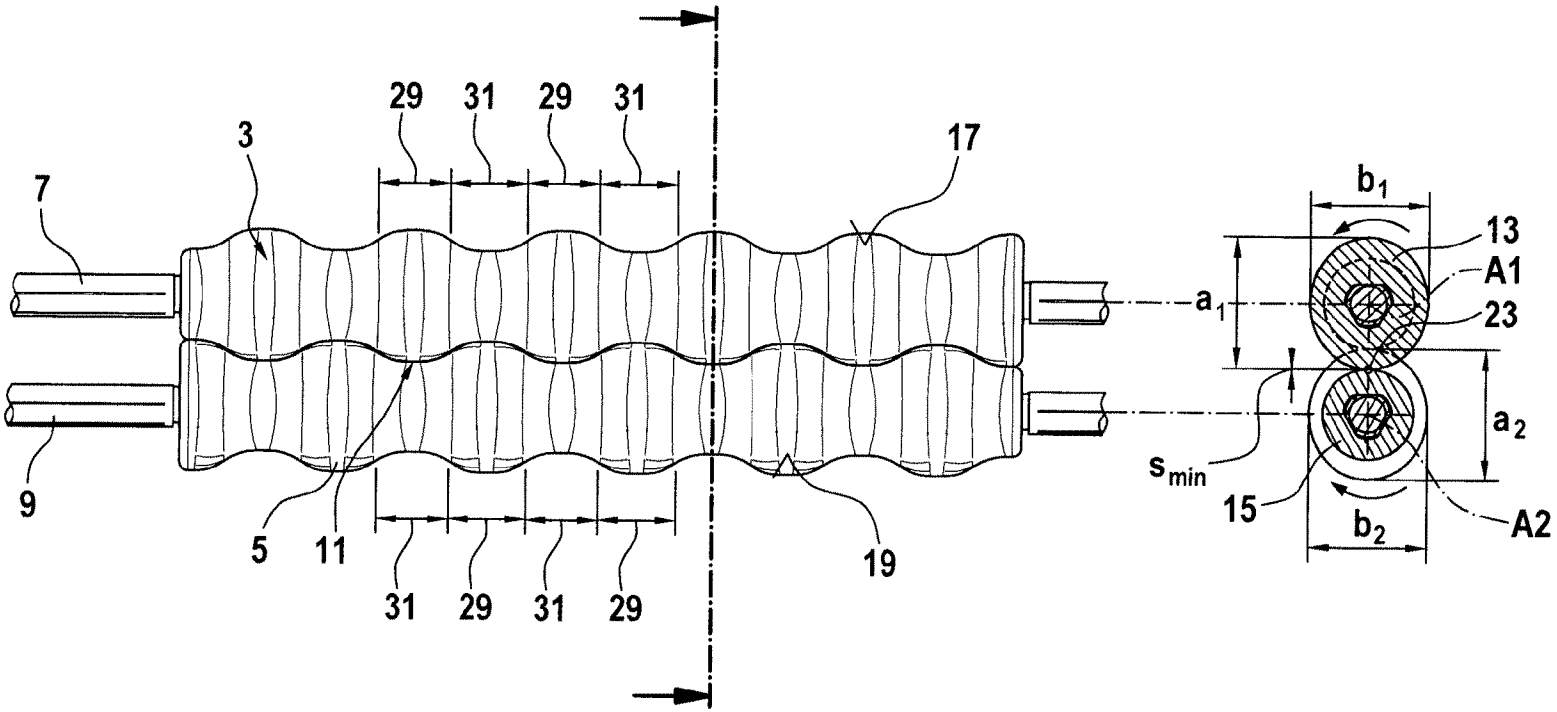
FIG. 2: A schematic view of the draw-in apparatus of FIG. 1 with the draw-in gap closed, and on the right an axial sectional view along the specified sectional line.

FIGS. 1 and 2 respectively show a schematic view of a draw-in apparatus looking in the draw-in direction at the draw-in gap formed by the draw-in rollers, arranged so as to be mutually neighboring.

The draw-in apparatus 1 consists substantially of two rotatable draw-in rollers, namely, an upper draw-in roller 3 and a lower draw-in roller 5, for drawing in sheet goods, such as bank notes. The upper draw-in roller 3 is arranged on an upper and the lower draw-in roller 5 is arranged on a lower shaft 9 for rotation around a respectively associated rotation axis A1, A2. The upper shaft 7 and the lower shaft 9 are rotatably mounted at a fixed distance and parallel to each other.

The draw-in rollers 3, 5 thus arranged so as to be mutually neighboring form a draw-in gap 11 for the sheet goods to be drawn in. The clearance between the draw-in rollers, i.e., the distance between the draw-in rollers' surfaces opposing each other at the draw-in gap, which define the draw-in gap, defines the height of the draw-in gap 11 and is designated here with the gap dimension s.

The axial cross-sectional profile 13 of the upper draw-in roller 3 is so designed in the viewed cross section that the gap dimension s of the draw-in gap 11 changes in a predetermined circumference or region in cooperation with the rotationally symmetric axial cross-sectional profile 15 of the lower draw-in roller 5 upon a rotation or by a rotation of the upper draw-in roller 3.

In the cross sections of the draw-in rollers shown in the right part of FIG. 1, the axial cross-sectional profile 13 of the upper draw-in roller 3 has a modulating circumferential line course in which the radius on the circumferential line changes in the circumferential direction continuously from at least one minimum value to at least one maximum value over the total circumference.

For the modulating circumferential line course the axial cross-sectional profile 13 of the upper draw-in roller 3 is configured elliptically in the roller portion of the shown cross-sectional view. In other words, the circumferential line of the upper draw-in roller 3 extends elliptically around the rotation axis A1. In contrast, the circumference of the axial cross-sectional profile 15 of the lower draw-in roller 5 extends in the roller portion of the shown cross-sectional view rotationally symmetrically to, and circularly around, the rotation axis A2.

The elliptical circumferential line of the axial cross-sectional profile 13 of the upper draw-in roller 3 can be described by a great principal axis al and a small principal axis b1. The axial cross-sectional profile 13 of the upper draw-in roller 3 is represented in a rotational position in which the gap dimension s of the draw-in gap 11 is maximal, for example 1.0 mm. That is to say, in this rotational position a circumferential point 21 of the outer surface 17 of the upper draw-in roller 3 is opposite the outer surface 19 of the lower draw-in roller 5, said point being intersected by the small principal axis b1 of the ellipse defining the axial cross-sectional profile 13 of the upper draw-in roller 3.

In FIG. 2 the arrangement of the draw-in rollers 3 and 5 is shown in a roller position rotated by 90° in comparison to FIG. 1. In the left part of FIG. 2 the upper draw-in roller 3 and the lower draw-in roller 5 are located relative to each other such that the draw-in gap 11 defined between the draw-in rollers has a minimal gap dimension $s_{min}$. That is to say, the draw-in gap 11 is closed, in this rotational position of the draw-in rollers 3, 5 relative to each other. Preferably, the minimal gap dimension $s_{min}$ is somewhat greater than 0 mm, particularly preferably approximately as great as the sheet thickness of the sheet goods intended to be drawn in. However, in certain embodiments it is also possible to configure the axial cross-sectional profiles of the draw-in rollers such that the minimal gap dimension in the closed rotational position is 0 mm.

In the right part of FIG. 2, the axial cross-sectional profiles 13, 15 of the lower and upper draw-in rollers 3, 5 are shown in this connection. In the roller portion of the shown cross-sectional view the elliptically designed axial cross-sectional profile 13 of the upper draw-in roller 3 is located in a rotational position in which the circumferential point 23 of the outer surface 17 on the circumference of the draw-in roller 3 almost touches the outer surface 19 of the lower draw-in roller 5.

The circumferential point 23 is intersected by the great principal axis al of the ellipse describing the axial cross-sectional profile 13. That is to say, the circumferential point 23 is a point that would lie on a contact line formed by the draw-in rollers 3, 5 between the surfaces 17, 19 of the draw-in rollers 3, 5 in the shown closed rotational position, at a minimal gap dimension of 0 mm.

When the minimal gap dimension $s_{min}$ in a closed rotational position is to be 0 mm, then the roller profiles are preferably so shaped (looking in a radial viewing direction at the respective draw-in roller) that a contact line between the surfaces 17, 19 of the draw-in rollers 3, 5 extends throughout, i.e., the draw-in gap 11 is then completely closed. There can thus be prevented not only the penetration of foreign bodies, such as dirt particles and dust, but also the penetration of liquids into the apparatus from outside.

As shown in FIGS. 1 and 2, the upper draw-in roller 3 has respectively periodically alternating first convex roller portions 29 and second concave roller portions 31 which alternate in the longitudinal direction of the draw-in roller 3. The course of the roller profile 27 of the lower draw-in roller 5 is configured mirror-symmetrically to the roller profile 25 of the upper draw-in roller 3.

The axial cross-sectional profiles 13 of the upper draw-in roller 3 and the axial cross-sectional profiles 15 of the lower draw-in roller 5 respectively have in their convex roller portions 29 the circumferential line course modulating the gap dimension of the draw-in gap and in their concave roller portions 31, respectively, a circumferential line course that extends rotationally symmetrically to, and circularly (e.g., a circular profile) around, the respective one of the rotation axes A1, A2. In other words, each of the draw-in rollers 3, 5 respectively possesses an axial cross-sectional profile with a circular circumferential line course in a concave roller portion 31 which is opposite a convex roller portion 29 of the other draw-in roller with a modulating circumferential line course.

It is of course also possible that the axial cross-sectional profiles 13 of the upper draw-in roller 3 and the axial cross-sectional profiles 15 of the lower draw-in roller 5 respectively have the circumferential line course modulating the draw-in gap 11 in the concave roller portions 31 and, respectively, have the circular circumferential line course (e.g., a circular profile) in the convex roller portions 29.

In principle it is also possible to configure the draw-in apparatus 1 such that at least one of the draw-in rollers 3, 5 has a circumferential line course modulating the draw-in gap both in the concave and in the convex roller portions. The other one of the two draw-in rollers 3, 5 is then configured in all roller portions with a circumferential line course that is circular and rotationally symmetric to the appurtenant rotation axis. That is to say, it is possible that only one of the draw-in rollers possesses cross-sectional profiles with a circumferential line course modulating the gap dimension of the draw-in gap, but then preferably over the total length of the draw-in gap 11. In contrast, the other one of the draw-in rollers then preferably has cross-sectional profiles with a circumferential line course that is circular and rotationally symmetric to the appurtenant rotation axis over the total length of the draw-in gap 11. In this case, for modulating the gap dimension only the draw-in roller with the circumferential line course modulating the gap dimension of the draw-in gap needs to be controlled for modulating the gap dimension.

Through the non-linear course of the draw-in gap 11 and the cross-sectional profile of the draw-in rollers 3, 5 modulating the gap dimension of the draw-in gap, a jerking on the card, which is haptically perceptible to the user, arises upon the rotational motion of the draw-in rollers when there is an attempt to feed objects thicker than sheet goods, such as an EC card or credit card, into the draw-in apparatus 1. The card is thereby pushed back in the direction of the user by a few millimeters contrary to the draw-in direction, for example out of the receiving slot 90 (cf. FIG. 7) of a machine in which the draw-in apparatus 1 is integrated. This results in the haptically perceptible feeling of rejection as an attention-catching feedback to the user.

The surfaces 17, 19 of the roller bodies forming the draw-in rollers 3, 5 are made of an inelastic material, such as a metal, a rigid plastic, or the like. Thus, the draw-in gap 11 formed by the draw-in rollers is less sensitive to attempts at tampering in comparison to draw-in rollers that are, for example, coated with a rubber-like material or consist of a material with high elasticity, since the material of the draw-in rollers cannot be pushed away or displaced as easily. Furthermore, with draw-in rollers made of an inelastic material, the meshing convex roller portions cannot be easily displaced. The meshing or interlacing of the radial roller profiles prevents flexurally rigid foreign bodies such as coins, EC cards, check cards, credit cards, or the like from being drawn in.

It is also possible to configure at least the surfaces 17, 19 of the draw-in rollers 3, 5 with an elastic material. Then the minimal gap dimension $s_{min}$ in the at least one closed rotational position can be adjusted to 0 mm. The elasticity of the surfaces 17, 19 of the draw-in rollers therefore in any case avoids drawn-in sheet goods being crushed in the closed rotational positions. Furthermore, the bearings of the draw-in rollers are not loaded.

As explained above, the upper draw-in roller 3 and the lower draw-in roller 5 possess roller profiles 25, 27 intermeshing due to the interlocking concave and convex roller portions 29, 31, regarded in the radial viewing direction, i.e., in the draw-in direction, as represented in FIGS. 1 and 2. The meshing roller profiles 25, 27 are preferably configured such that the draw-in gap 11 extends non-linearly transversely to the draw-in direction such that sheet goods that can be drawn in are bowed in a wave shape between the draw-in rollers 3, 5 and a draw-in force exerted by the draw-in rollers on the sheet goods, by which force the sheet goods are gripped by the draw-in apparatus 1, depends substantially on the rigidity of the sheet goods.

Figure 3:
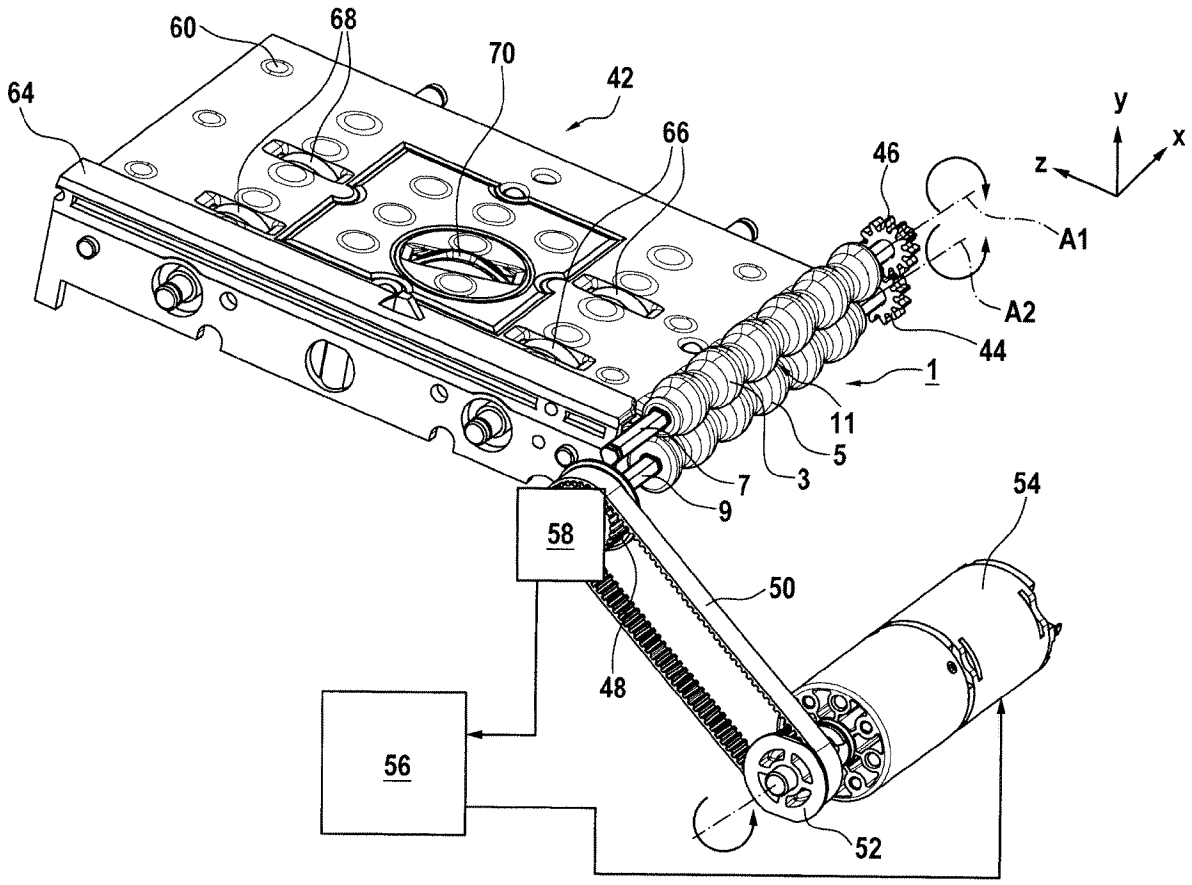
FIG. 3: A perspective view of the draw-in apparatus of FIGS. 1 and 2 with an adjoining transport and aligning portion for drawn-in sheet goods.

FIG. 3 shows a perspective view of the parts of a transport and aligning portion for sheet goods and of the upstream draw-in apparatus 1 of FIGS. 1 and 2.

Figure 6:
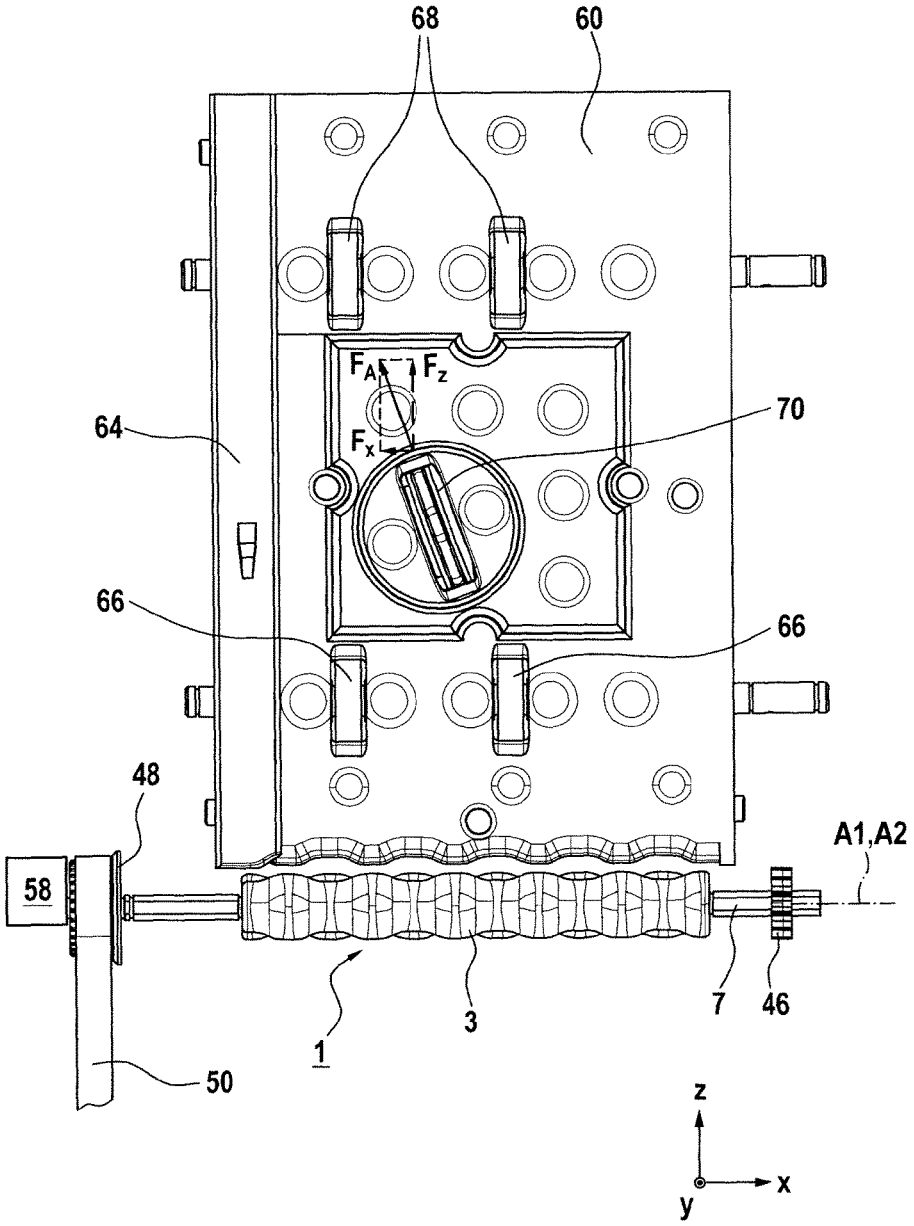
FIG. 6: A plan view of the arrangement of FIG. 3 for illustrating the transport and aligning portion for sheet goods.
Figure 7:
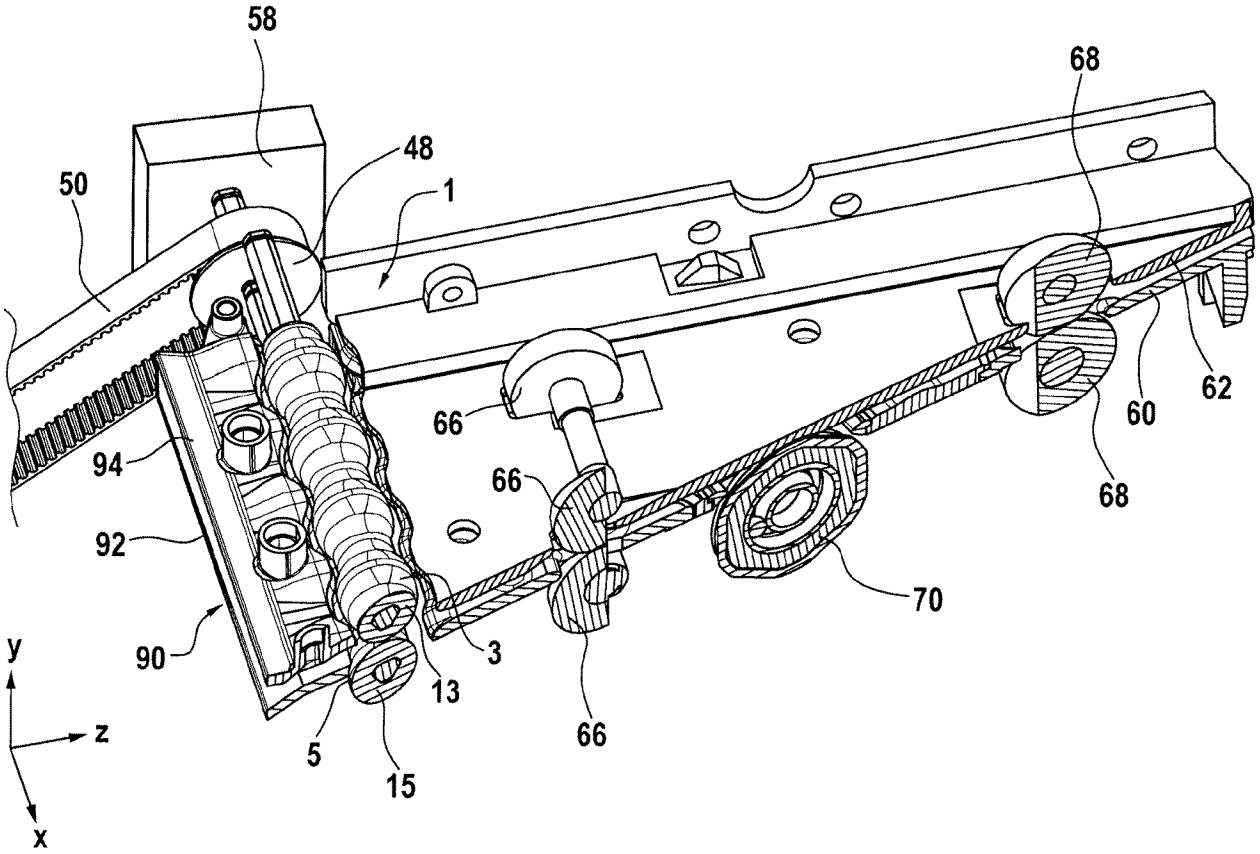
FIG. 7: A perspective view of the arrangement of FIGS. 3 and 6 with a sectional representation for illustrating the transport path of sheet goods through the draw-in apparatus and the adjoining transport and aligning portion.

For better orientation, FIGS. 3, 6 and 7 respectively specify a reference coordinate system whose axes are so oriented that the z-axis extends in the draw-in direction and the rotation axes A1, A2 extend in the direction of the x-axis. The gap dimension s of the draw-in gap 11 of the draw-in apparatus 1 is then defined in the direction of the y-axis.

In the perspective representation of FIG. 3 the two draw-in rollers 3, 5 are rotatable around their respective rotation axes A1, A2 and the shafts 7, 9, respectively bearing one of the draw-in rollers 3, 5, are arranged at a fixed distance apart. Further, the rotation axes A1, A2 extend parallel to each other and are arranged transversely to the draw-in direction z through the draw-in apparatus 1.

The upper draw-in roller 3 and the lower draw-in roller 5 are force-coupled to two meshing coupling gears 44, 46 in the represented embodiment example. For this purpose, a first coupling gear 44 is arranged non-rotatably on the shaft 9 of the lower draw-in roller 5 and meshes with a corresponding second coupling gear 46 which is arranged non-rotatably on the shaft 7 of the upper draw-in roller 3.

At an end of the shaft 9 opposing the end with the first coupling gear 44 of the shaft 9 there is non-rotatably fastened a roller drive wheel 48 which is coupled to a drive wheel 52 of a drive 54 via a driving belt 50. For better coupling, the belt 50 is configured as a toothed belt and the roller drive wheel 48 on the shaft 9 and the drive wheel 52 of the drive 54 are configured with toothed ribs for non-slip force transmission by form locking. Therefore, the draw-in apparatus 1 can be operated via the motor 54 for drawing in sheet goods. Furthermore, the draw-in gap 11 can be closed by rotation of the lower draw-in roller 5 and the upper draw-in roller 3 into a closed position.

Due to the non-slip coupling of the drive wheel 52 with the roller drive wheel 48, the draw-in rollers 3, 5 can be stopped exactly and in a predetermined position relative to each other in any rotational position, in particular in a closed rotational position.

To enable the draw-in rollers 3, 5 of the draw-in apparatus 1 to be brought into a defined closed rotational position, the drive 54 must be controlled accordingly. For this purpose, a control device 56 is coupled to a device 58 for detecting the at least one closed rotational position as a defined rotational position of the draw-in rollers.

The device 58 for detecting the at least one closed rotational position (closed rotational position detecting device 58) is operatively coupled to the drive wheel 48 of the shaft 9 in the embodiment example. The closed rotational position detecting device 58 has at least one sensor which is designed for sensing at least one marking means firmly coupled to the lower draw-in roller 5. With the help of the marking means one can unambiguously detect when the draw-in rollers 3, 5 are located in the at least one closed rotational position.

For example, the closed rotational position detecting device 58 can have for this purpose at least one light sensor, magnetic sensor, capacitive sensor, or the like. The marking means provided on the draw-in roller 5 is configured according to the basic physical principle of the sensor used.

Preferably, a device in the form of an absolute value transmitter is used in the closed position detecting device 58. Such an absolute value transmitter (here, somewhat more precisely, an absolute angle transmitter) for detecting the at least one closed rotational position is an angle measuring device by which an absolute angle measurement value or an absolute difference relative to a reference angular position is available without referencing immediately after the device is switched on.

Examples of absolute value transmitters to be mentioned are accordingly encoded incremental angle transmitters which can be based, for example, on an optical principle, or evaluation devices designed by means of a magnetic mark and accordingly arranged magnetic-field sensors.

Figure 4:
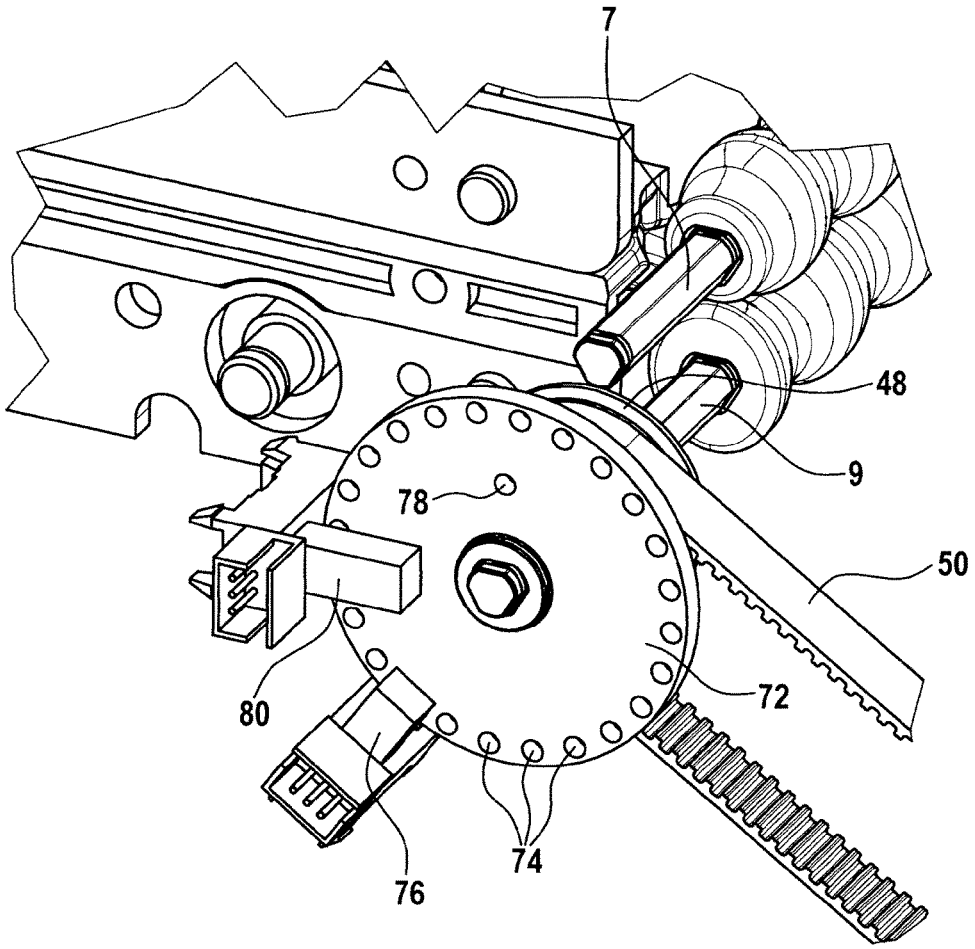
FIG. 4: A detailed view of FIG. 3 with a first embodiment of a detecting device for a closed rotational position as a defined rotational position of the draw-in rollers.
Figure 5:
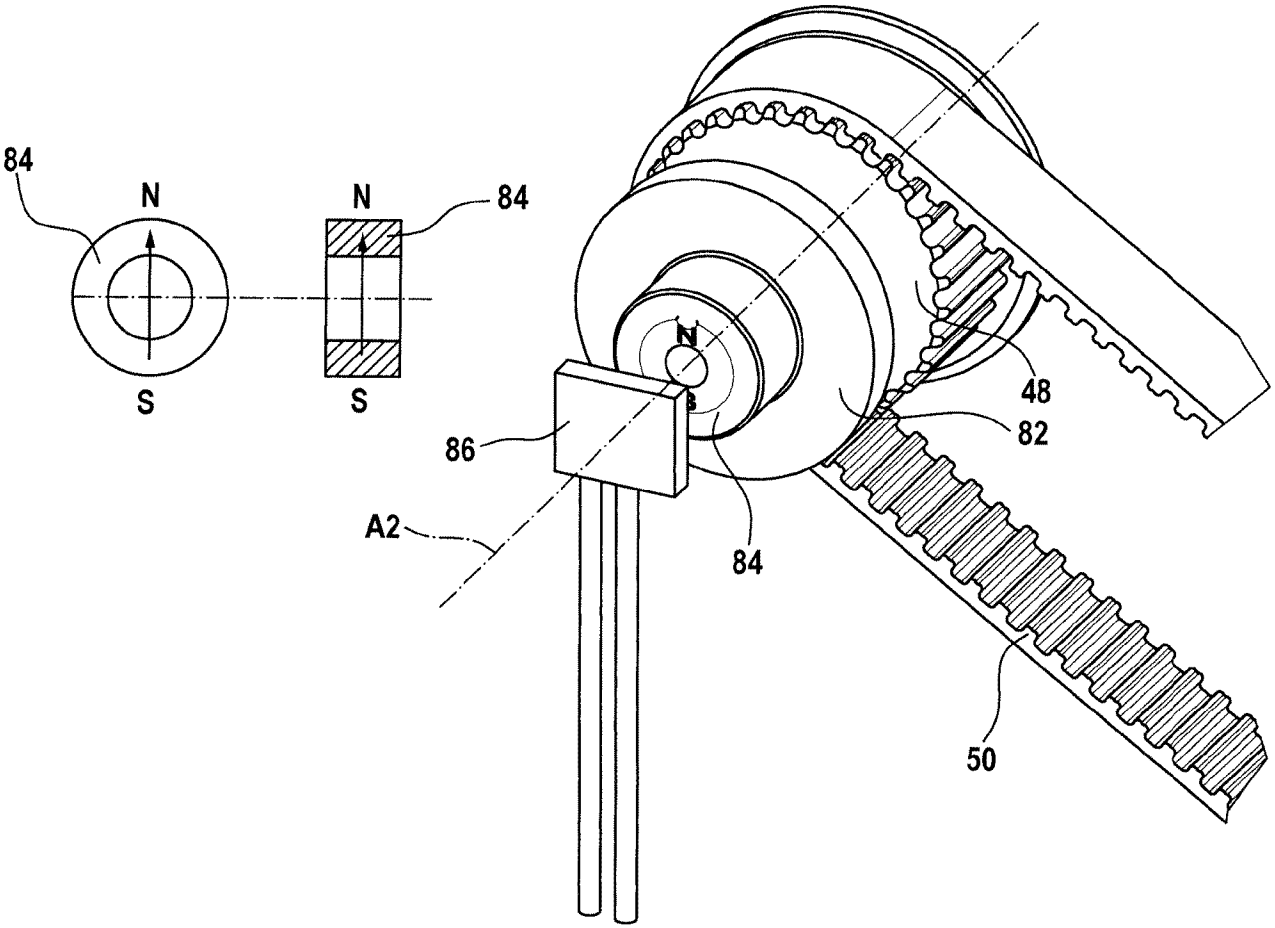
FIG. 5: A detailed view of FIG. 3 with a second embodiment of a detecting device for a closed rotational position of the draw-in rollers.

With reference to FIGS. 4 and 5, two possible embodiments of the closed rotational position detecting device 58 will be explained further down.

First, still with reference to FIG. 3, the transport and aligning portion 42 for sheet goods that adjoins the draw-in apparatus 1 will be briefly explained. The draw-in apparatus 1 is adjoined by a transport gap extending in the z direction and defined by a lower guiding element 60 and an upper guiding element 62 (see FIG. 7).

Viewed on the left in the draw-in direction, there extends as the left limit of the transport gap an aligning edge 64 on which drawn-in, in particular rectangular, sheet goods are so aligned by the transport and aligning portion 42 during the transport operation such that two mutually opposing outer edges of the sheet goods extend parallel to the aligning edge 64, after alignment has taken place, and an outer edge of the sheet goods lies against the aligning edge 64.

For this purpose, the transport and aligning portion 42 has, in two regions, transport wheels 66, 68 which respectively engage into the transport gap pairwise out of the lower guiding element 60 and upper guiding element 62 (cf. FIG.

7) and convey drawn-in sheet goods in the z direction. The transport wheels 66, 68 are arranged on associated drive shafts which are driven by a drive not shown or specifically described here.

For an aligning of the drawn-in sheet goods on the aligning edge 64, a polygonal wheel 70 is integrated as an aligning means in the middle of the transport and aligning portion 42. The polygonal wheel 70 is arranged at a predetermined angle transversely to the draw-in direction z and dips perpendicularly into the transport gap out of the lower guiding element 60, while additionally (cf. FIG. 7) dipping with a part of its circumference into a corresponding recess of the upper guiding element 62. With the polygonal wheel 70 there can be transferred to drawn-in sheet goods being transported in the draw-in gap in the z direction a force Fx that is directed in the direction of the aligning edge 64 and necessary for alignment on the aligning edge 64.

FIG. 4 shows a first embodiment of the closed rotational position detecting device 58 of FIG. 3. For detecting the closed rotational position of the draw-in rollers 3, 5 there is fastened non-rotatably to the shaft 9 of the lower draw-in roller 5 in this embodiment besides the roller drive wheel 48 an indexing plate 72. In the indexing plate are arranged first index holes 74 regularly spaced on a circular path neighboring the edge, which cooperate operatively with a first light-barrier device 76.

The first light-barrier device 76 is arranged on indexing plate 72 and grips it in the manner of tongs, so that the indexing plate 72 is in engagement with the first light-barrier device 76. Upon rotation of the indexing plate 72 synchronously with the drive wheel 48, the rotation of the draw-in rollers 3, 5 can be monitored via the first light-barrier device 76.

At a further place on the indexing plate 72 there is provided a second index hole 78 which cooperates operatively with a second light-barrier device 80, on the same principle as the first light-barrier device 76 with the index holes 74. The second index hole 78 is so arranged in the indexing plate 72 that when the second light-barrier device 80 senses the second index hole 78, the draw-in rollers 3 and 5 are located in a closed rotational position.

For transmission of corresponding sensor signals generated by the first and second light-barrier devices 76, 80 the light-barrier devices 76, 80 are connected operatively to the control device 56 of FIG. 3 via known communication connections, e.g., cable connections, not specifically shown.

As already noted, the draw-in apparatus 1 possesses a closed rotational position, in which the draw-in gap 11 is closed, at every half-rotation (1800) due to the elliptically configured modulating roller portions of the draw-in rollers 3, 5. That is to say, there can be arranged in the indexing plate 72 a further second index hole opposing the second index hole 78 in order to enable the second closed position to be detected as well.

FIG. 5 shows an alternative embodiment for a closed rotational position detecting device 58. A diametrically magnetized magnet is attached to the drive wheel 48 of the shaft 9 for the lower draw-in roller 5 concentrically with the rotation axis A2. That is to say, the marking means for identifying the at least one closed rotational position is the magnetic field influenced in the field distribution by the diametrically magnetized magnet 84. For better illustration, there is shown on the left in FIG. 5 a schematic representation of a diametrically magnetized magnet 84 on the left in a plan view in the direction of the rotation axis A2 and on the right in a sectional representation in the draw-in direction z direction.

For evaluating the rotational position of the lower draw-in roller 5 and therefore also of the synchronously co-rotating upper draw-in roller 3, an accordingly configured magnetic-field sensor 86 is contactlessly arranged neighboring to the carrier disk 82 of the magnet 84.

The sensor 86 can have, for example, four integrated Hall sensor elements which, via an accordingly configured evaluation device with for example an integrated CORDIC (COordinate Rotation Digital Computer), are able to evaluate sinusoidal mutually phase-shifted signals of the four Hall sensors, generated by the rotating magnetic field of the magnet 84, such that it is at any time possible to unambiguously determine the absolute rotation angle of the draw-in roller 5 over the full 360° angle range.

As a result, the sensor 86 can output a signal representing the current rotational position of the draw-in rollers 3, 5. Through a corresponding association of the angular positions of the magnet 84 with the associated closed rotational positions of the draw-in rollers 3, 5 there can, similarly to the embodiment shown in FIG. 4, be made available to the control device 56 (see FIG. 3) unambiguous information in order to control the drive 54 such that, upon stopping of the draw-in rollers 3, 5, they are located in the closed rotational position and the draw-in gap 11 is closed.

FIG. 6 shows a plan view of FIG. 3 for illustrating the transport and aligning portion 42 and for the transition from the draw-in apparatus 1 thereto. FIG. 7 shows a perspective view of the arrangement of FIGS. 3 and 6, as well as a sectional representation oblique to the transport direction (z direction) for illustrating the transport path for sheet goods between the lower and upper guiding elements 60, 62.

Besides the details already explained in connection with FIGS. 1 to 6, some brief remarks will be made here on the feeding device 90 upstream of the draw-in apparatus 1. The feeding device 90 is a solid funnel element which feeds sheet goods to be fed to the draw-in apparatus 1 through its feeding flanks 92, 94 tapered in a funnel shape. In so doing, the funnel function supports the aligning of the leading edge of fed sheet goods with the draw-in gap 11 of the draw-in apparatus 1 as centrally and perpendicularly as possible. This avoids jammed feeding of sheet goods. Furthermore, the solid funnel device 90 also has a mechanical protection function, in order to mechanically counteract unauthorized access from outside, for example, attempts at tampering or vandalism, and to protect the draw-in rollers from damage.

The invention claimed is:

1. A draw-in apparatus comprising:

at least two rotatable draw-in rollers for drawing in sheet goods, in particular bank notes, wherein the draw-in rollers are arranged relative to each other with meshing roller profiles respectively extending transversely to a draw-in direction so as to define a draw-in gap for the sheet goods, wherein the draw-in gap has a height defined as a minimum distance between surfaces of the draw-in rollers, and wherein the draw-in rollers comprise axial cross-sectional profiles mutually matched such that the height of the draw-in gap changes periodically upon rotation of the draw-in rollers during the drawing in of the sheet goods via the rotation of the draw-in rollers of the draw-in apparatus.

2. The draw-in apparatus according to claim 1, wherein the draw-in rollers comprise roller profiles that intermesh, as viewed in the draw-in direction, with alternating first and second roller portions.

3. The draw-in apparatus according to claim 2, wherein the roller portions comprise convex roller portions and concave roller portions alternating in a longitudinal direction on the respective draw-in roller, which are preferably respectively half-wave-shaped.

4. The draw-in apparatus according to claim 1, wherein the axial cross-sectional profile of at least one of the draw-in rollers has, at least in one roller portion, a circumferential line course, modulating the height of the draw-in gap, whose radius changes continuously between at least one minimum value and at least one maximum value, with the circumferential line course preferably being cam-shaped or elliptical.

5. The draw-in apparatus according to claim 4, wherein the axial cross-sectional profile of the draw-in rollers respectively has an axial cross-sectional profile with a circular circumferential line course in those roller portions opposing a roller portion of another draw-in roller with a modulating circumferential line course.

6. The draw-in apparatus according to claim 4, wherein the at least one of the draw-in rollers has a modulating circumferential line course in all roller portions and the other one of the draw-in rollers has a circular circumferential line course in all roller portions, or wherein both draw-in rollers have a modulating circumferential line course in all roller portions.

7. The draw-in apparatus according to claim 4, wherein a first draw-in roller and a second draw-in roller respectively have a modulating circumferential line course in convex roller portions and have a circular circumferential line course in concave roller portions, or vice versa.

8. The draw-in apparatus according to claim 1, wherein the draw-in gap has a minimal height in at least one rotational position of the draw-in rollers.

9. The draw-in apparatus according to claim 8, wherein the axial cross-sectional profile of at least one of the draw-in rollers has a form of an ellipse with a greatest principal axis adjusted so that the height of the draw-in gap is minimal, in particular 0, in one rotational position, and that a maximum height is determined by a small principal axis of the ellipse.

10. The draw-in apparatus according to claim 1, wherein the draw-in gap extends non-linearly transversely to the draw-in direction, so that sheet goods drawn in are bowed between the draw-in rollers and a draw-in force exerted on the sheet goods by the draw-in rollers is determined substantially by a rigidity of the sheet goods.

11. The draw-in apparatus according to claim 1, wherein the at least two draw-in rollers are arranged rotatably around respective rotation axes which are at a fixed distance apart and which are preferably arranged parallel to each other and transversely to the draw-in direction.

12. The draw-in apparatus according to claim 1, wherein the at least two draw-in rollers are rotationally force-coupled at least at one end, preferably by gears, and one of the draw-in rollers is coupled to a device for detecting at least one defined rotational position.

13. The draw-in apparatus according to claim 12, wherein the device for detecting the at least one defined rotational position comprises at least one sensor, in particular a light sensor, magnetic sensor or capacitive sensor, for sensing at least one marking device firmly coupled to one of the draw-in rollers.

14. The draw-in apparatus according to claim 13, wherein the marking device comprises at least one index hole in an indexing plate coupled to the at least one draw-in roller, and the device for detecting the at least one defined rotational position has a light-barrier sensor arranged so as to cooperate operatively with the indexing plate; or wherein the marking device comprises a diametrically magnetized magnet on the at least one draw-in roller, and the device for detecting the at least one defined rotational position has at least one magnetic sensor, in particular Hall sensors; or wherein the device for detecting the at least one defined rotational position is a 360° absolute angle sensor coupled to at least one of the draw-in rollers.

15. The draw-in apparatus according to claim 12, further comprising:

an, in particular exclusive, draw-in roller drive coupled to the draw-in rollers; and a control device operatively connected to the draw-in roller drive, wherein the control device is connected to the device for detecting the at least one defined rotational position and is configured to control the draw-in roller drive such that the draw-in rollers are located in the at least one defined rotational position at the moment of stopping of the rotational motion of the draw-in rollers.

16. The draw-in apparatus according to claim 2, wherein the axial cross-sectional profile of at least one of the draw-in rollers has, at least in one roller portion, a circumferential line course, modulating the height of the draw-in gap, whose radius changes continuously between at least one minimum value and at least one maximum value, with the circumferential line course preferably being cam-shaped or elliptical.

17. The draw-in apparatus according to claim 3, wherein the axial cross-sectional profile of at least one of the draw-in rollers has, at least in one roller portion, a circumferential line course, modulating the height of the draw-in gap, whose radius changes continuously between at least one minimum value and at least one maximum value, with the circumferential line course preferably being cam-shaped or elliptical.

18. The draw-in apparatus according to claim 5, wherein a first draw-in roller and a second draw-in roller respectively have a modulating circumferential line course in convex roller portions and have a circular circumferential line course in concave roller portions, or vice versa.

19. The draw-in apparatus according to claim 13, further comprising:

an, in particular exclusive, draw-in roller drive coupled to the draw-in rollers; and a control device operatively connected to the draw-in roller drive, wherein the control device is connected to the device for detecting the at least one defined rotational position and is configured to control the draw-in roller drive such that the draw-in rollers are located in the at least one defined rotational position at the moment of stopping of the rotational motion of the draw-in rollers.

20. The draw-in apparatus according to claim 14, further comprising:

an, in particular exclusive, draw-in roller drive coupled to the draw-in rollers; and a control device operatively connected to the draw-in roller drive, wherein the control device is connected to the device for detecting the at least one defined rotational position and is configured to control the draw-in roller drive such that the draw-in rollers are located in the at least one defined rotational position at the moment of stopping of the rotational motion of the draw-in rollers.

* * * * *